US008721122B2

(12) United States Patent
Tong

(10) Patent No.: US 8,721,122 B2
(45) Date of Patent: May 13, 2014

(54) LIGHTED WOBBLE HEAD SYSTEM

(75) Inventor: Ricky Tong, Hong Kong (CN)

(73) Assignee: Polygroup Macau Limited (BVI), Tortola (VG)

( * ) Notice: Subject to any disclaimer, the term of this patent is extended or adjusted under 35 U.S.C. 154(b) by 505 days.

(21) Appl. No.: 13/030,463

(22) Filed: Feb. 18, 2011

(65) Prior Publication Data

US 2012/0044683 A1 Feb. 23, 2012

Related U.S. Application Data

(60) Provisional application No. 61/305,587, filed on Feb. 18, 2010.

(51) Int. Cl.
*F21L 2/00* (2006.01)

(52) U.S. Cl.
USPC ..... 362/249.14; 362/249.16; 362/806

(58) Field of Classification Search
USPC ..... 362/249.14, 249.01, 249.04, 249.06, 362/249.08, 249.16, 806; 29/428; 446/73, 446/268, 330
See application file for complete search history.

(56) References Cited

U.S. PATENT DOCUMENTS

| | | | | |
|---|---|---|---|---|
| 5,453,664 | A * | 9/1995 | Harris | 315/185 S |
| 7,143,912 | B2 * | 12/2006 | Caneba | 224/153 |
| 7,152,998 | B2 * | 12/2006 | Rahman | 362/249.19 |
| 7,473,155 | B1 * | 1/2009 | Klundt et al. | 446/207 |
| 2005/0136197 | A1 * | 6/2005 | Liu | 428/13 |
| 2007/0089334 | A1 * | 4/2007 | Sullivan et al. | 40/421 |
| 2007/0094907 | A1 * | 5/2007 | Scarberry | 40/610 |
| 2007/0159815 | A1 * | 7/2007 | Bayat et al. | 362/157 |
| 2008/0085654 | A1 * | 4/2008 | Hoeting et al. | 446/73 |
| 2009/0247375 | A1 * | 10/2009 | Smith | 482/110 |

* cited by examiner

*Primary Examiner* — Sharon Payne
(74) *Attorney, Agent, or Firm* — Troutman Sanders LLP; Ryan A. Schneider; Benjamin C. Wiles

(57) ABSTRACT

A decorative system comprises a body, a biasing member, a head, and a light string system. The decorative system can further comprise a base. The biasing member is carried by the body such that a first end of the biasing member is in communication with the body and the second end is in communication with the head. The head is adapted to wobble or bobble relative to the body upon contact with the body or head. The decorative system can comprise an inner body and an outer body wherein the outer body is adapted to wobble or bobble relative to the inner body. The light string system can be carried by the body, the biasing member, and/or the head. The light string system comprises a plug for insertion into an outlet, wiring, a plurality of bulb assemblies, wherein each bulb assembly comprises a light source and a socket assembly.

19 Claims, 6 Drawing Sheets

LIGHTED WOBBLE HEAD SYSTEM

CROSS REFERENCE TO RELATED APPLICATIONS

This application claims benefit under 35 USC §119(e) of U.S. Provisional Patent Application Ser. No. 61/305,587 filed 18 Feb. 2010, the entire contents of which are hereby incorporated fully herein by reference.

BACKGROUND

1. Field of the Invention

Embodiments of the present invention relate to decorative systems and, more particularly, to a decorative lighted wobble head system.

2. Description of the Related Art

Decorative systems are widely used during holidays, festivals, in celebrations, and general decoration. Decorative systems can include, for example and not limitation, icicle lights, lighted and/or motorized decorations, and lighted signs. Decorative systems can also comprise a wobble, or bobble, head system.

A bobble head is a well-known apparatus that supports a head atop a lower member (e.g., a body) to create a figurine—human or otherwise. The typical bobble head comprises a spring, or other biasing device, that is disposed between the head and the body.

Generally, the spring supports the head above the body and allows the head to shake slightly up/down, tilt from side-to-side, forward and back, and even to rotate slightly (i.e., to turn from right to left). The head wobbles or "bobbles" in response to movements that are transferred to the head and/or the body. The spring transfers energy between the body and the head to impart a range of motion to the head relative to the body that appears to bring a level of animation to the head. This increases the novelty and entertainment value of the device.

Figurines that include a bobble head are well known devices. They are sold for use both as toys and as novelty items. Bobble heads are often given away at sporting events and represent, for example, the players and/or coaches. A similar concept is the "hula girl" in which the figurine's grass skirt bobbles, as opposed to the head, simulating the Hawaiian hula dance.

The term bobble head, therefore, can represent many types of designs in which a portion of a figurine, or other object, is supported by a spring that allows movement with respect to the remainder of the object. In the case of a bobble head, the upper half is attached to the lower half with a spring and the lower half is attached to a base portion. As a result, the head can move and tilt with respect to the body.

SUMMARY

Briefly described, embodiments of the present invention can comprise a decorative system comprising a body, a biasing member, a head, and a light string system. In some embodiments, the decorative system can comprise a wobble or bobble head system.

In some embodiments, the body of the decorative system can provide a base for the decorative system. The body can be formed to have a particular shape for the decorative system. The body can have various shapes, as desired, to form the decorative system. The body can comprise, for example and not limitation, a snowman, Santa Claus, an athlete, a coach, or a mascot.

The biasing member, which in some embodiments can be, for example and not limitation, a flat or wound spring can be carried by the body. In some embodiments, a first end of the biasing member can be in communication with the body, while a second end of the biasing member can be in communication with the head of the decorative system. In other words, the head can be carried by the biasing member via the body. The biasing member can enable the head to wobble or bobble relative to the body. Because the body carries both the biasing member and the head, it can be useful for the body to be larger (in size or mass) than the head.

In other embodiments, the biasing member can connect an inner body with an outer body to enable the outer body to move with respect to the inner body. This configuration can enable the outer body to simulate running, dancing, or other movements. In still other embodiments, both the head and the outer body can be connected to the inner body with one or more biasing members.

Embodiments of the present invention can further comprise a light string system. The light string system can be carried by the body, the biasing member, and/or the head. The light string system can comprise one or more plugs to supply power to the light string system. The light string system can comprise wiring and a plurality of bulb assemblies, wherein each bulb assembly comprises a light source and a socket assembly. The plurality of light bulb assemblies can be wired in series or in parallel as appropriate.

These and other objects, features, and advantages of the present invention will become more apparent upon reading the following specification in conjunction with the accompanying drawings.

DETAILED DESCRIPTION

Figure 1:
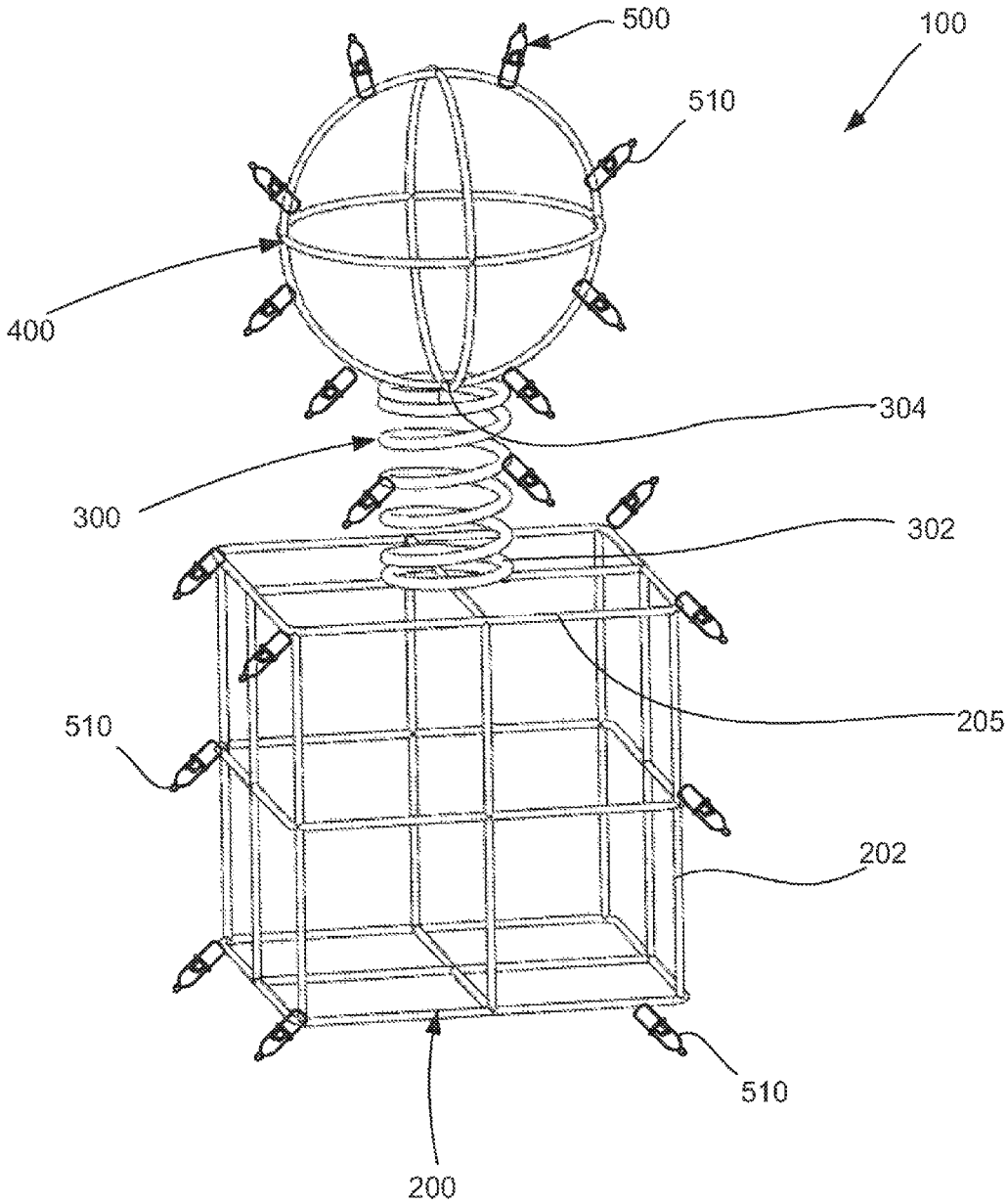
FIG. 1 is a perspective view of a decorative system, in accordance with an exemplary embodiment of the present invention.

To facilitate an understanding of the principles and features of the various embodiments of the invention, various illustrative embodiments are explained below. Although preferred embodiments of the invention are explained in detail, it is to be understood that other embodiments are contemplated. Accordingly, it is not intended that the invention is limited in its scope to the details of construction and arrangement of components set forth in the following description or illustrated in the drawings. The invention is capable of other embodiments and of being practiced or carried out in various ways. Also, in describing the preferred embodiments, specific terminology will be resorted to for the sake of clarity.

It must also be noted that, as used in the specification and the appended claims, the singular forms "a," "an" and "the" include plural references unless the context clearly dictates otherwise. For example, reference to a component is intended also to include composition of a plurality of components. References to a system containing "a" component is intended to include other components in addition to the one named.

Also, in describing the preferred embodiments, terminology will be resorted to for the sake of clarity. It is intended that each term contemplates its broadest meaning as understood by those skilled in the art and includes all technical equivalents, which operate in a similar manner to accomplish a similar purpose. Ranges may be expressed herein as from "about" or "approximately" one particular value and/or to "about" or "approximately" another particular value. When such a range is expressed, other exemplary embodiments include from the one particular value and/or to the other particular value.

The words "comprising," "containing," or "including" conveys that at least the named compound, element, particle, or method step is present in the composition or article or method, but does not exclude the presence of other compounds, materials, particles, method steps, even if the other such compounds, material, particles, method steps have the same function as what is named.

It is also to be understood that the mention of one or more method steps does not preclude the presence of additional method steps or intervening method steps between those steps expressly identified. Similarly, it is also to be understood that the mention of one or more components in a composition does not preclude the presence of additional components than those expressly identified.

Referring now to the figures, wherein like reference numerals represent like parts throughout the views, embodiments of the present invention will be described in detail.

As shown in FIG. 1, embodiments of the present invention comprise a decorative system 100. The decorative system 100 can comprise a body 200, a biasing member 300, a head 400, and a light string system 500. In some embodiments, the decorative system 100 can be a wobble or bobble head system. The decorative system 100 can be partially or wholly collapsible for, among other things, storage and/or shipping convenience.

In some embodiments, the body 200 of the decorative system 100 can provide a base for the decorative system 100. The body 200 can be formed to have a particular shape for the decorative system 100. The body 200 can have various shapes such as, for example and not limitation, a snowman, Santa Claus, or a famous athlete. In an exemplary embodiment, the body 200 can include a plurality of frame members 262, which can be interconnected, to provide the support for the decorative system 100. In other words, the frame members 262 can form a skeleton for the body 200.

In some embodiments, the body 200 can have a first, collapsed state and a second, erect state. In the first state, the system 100 can be collapsed, which can be preferable when shipping and/or storing the decorative system 100. In this configuration, the frame members 262 can be partially detached to fold or collapse into a substantially flat package. In the second state, the system 100 can be assembled or erected, preferable when using and displaying the decorative system 100.

Figure 2A:
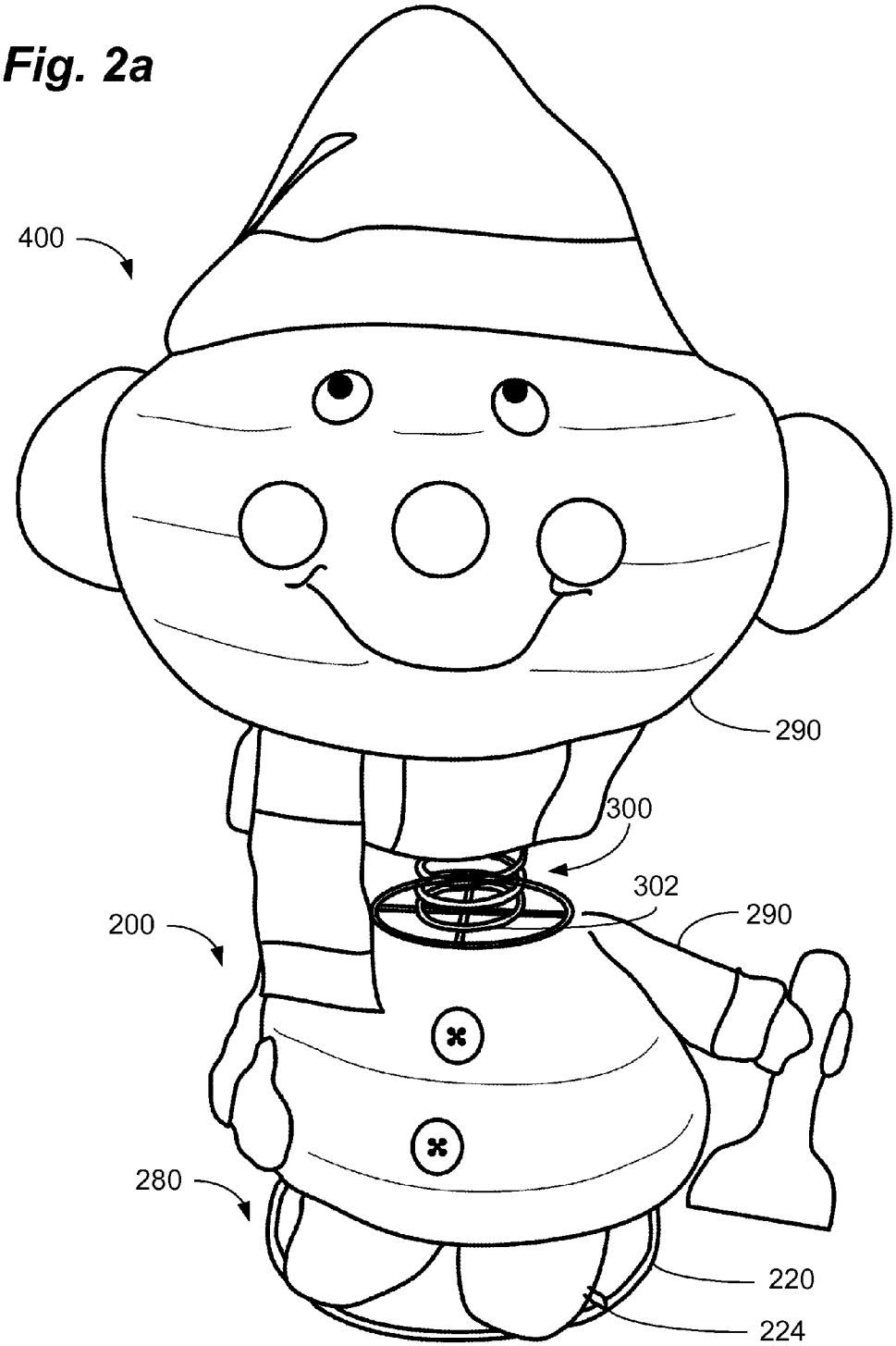
FIG. 2*a* is a perspective view of a snowman embodiment of the decorative system, in accordance with an exemplary embodiment of the present invention.
Figure 2B:
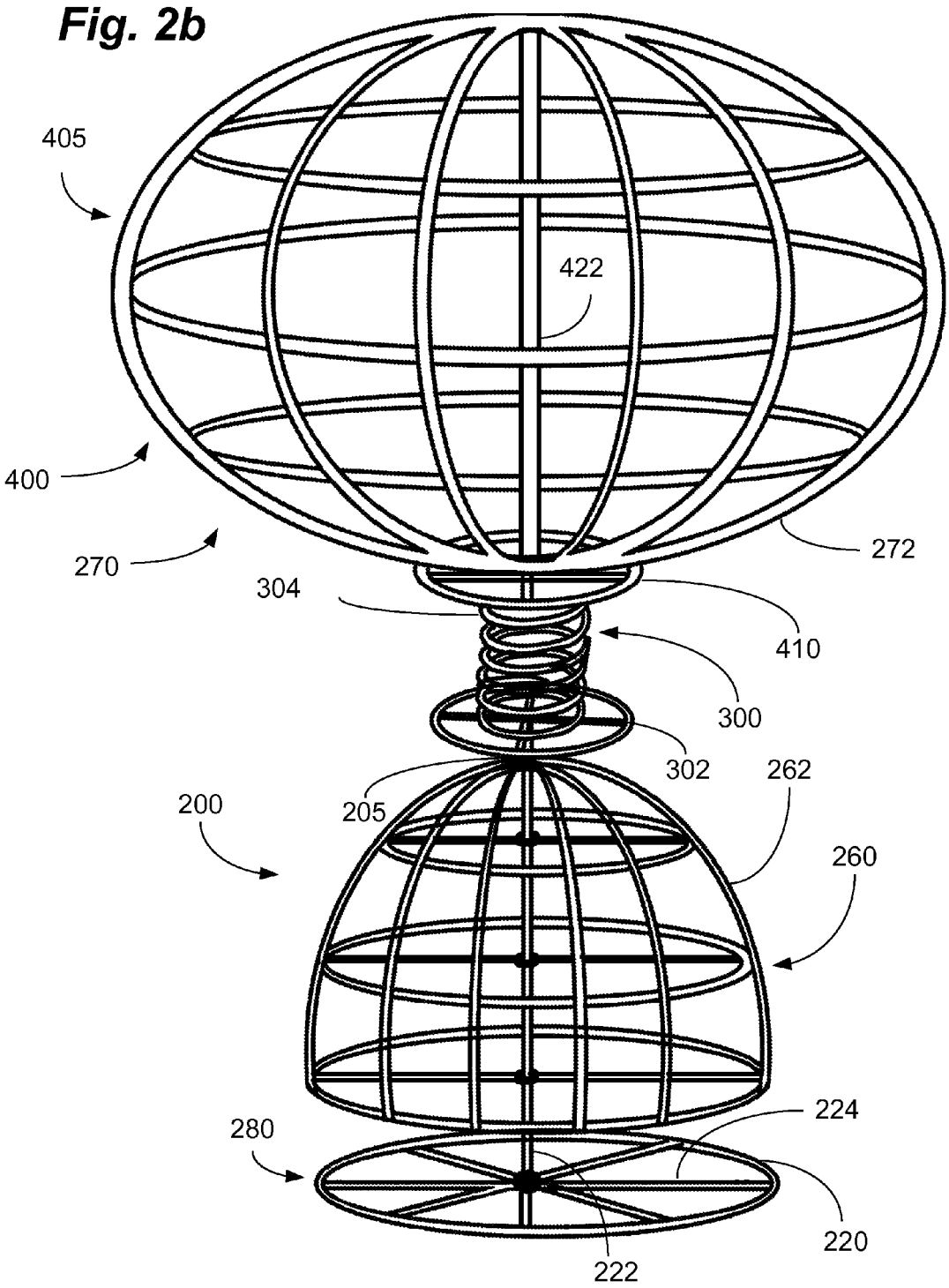
FIG. 2*b* is a front, perspective view of a frame for the decorative system, in accordance with an exemplary embodiment of the present invention.

As shown in FIGS. 2*a* and 2*b*, in an exemplary embodiment, the body 200 can comprise a first base 220, a first frame assembly 260, a second frame assembly 270, a mount assembly 280, and a covering 290. The first base 220 of the body 200 can provide the foundation for the decorative system 100, and can be the lowest support of the decorative system 100. The first base 220 can be in contact with the surface upon which the decorative system 100 rests. In an exemplary embodiment, the first base 220 includes a bottom, which can be flat or contoured depending on the intended mounted surface (e.g., a roof mount may have an appropriate tilt). The first base 220 can further comprise a first upright 222, which can extend upwardly from the first base 220.

In some embodiments, the first base 220 can include a rigid perimeter and an interior. In an exemplary embodiment, the first upright 222 can be coupled to a portion of the interior of the first base 220. For example, as shown, the perimeter of the first base 220 can include a circular shape, which is held together by the interior comprising one or more intersecting elongated members 224, which can, for example, have an X or star shape. In some embodiments, the center of the X or star shape can be in communication with the extending first upright 222. In other embodiments, the interior of the first base 220 can include other shapes to support the extending first upright 222.

As mentioned, the body 200 can include a first frame assembly 260, a second frame assembly 270, and a mount assembly 280. The first frame assembly 260 can comprise one or more first frame members 262, which can generally form a skeleton or support for the body 200. The second frame assembly 270 can comprise one or more second frame members 272, which can generally form a skeleton or support framework for the head 400.

In an exemplary embodiment, there can be a plurality of frame assemblies used to help support one or more appropriately sized decorative coverings 290. Depending on the shape and size of the body 200, and thus the decorative system 100, a plurality of frame members 262, 272 can be included and may or may not be connected or in communication with one another. Collectively, the frame assemblies 260 and 270 can provide the shape of the body 200.

The frame assemblies 260 and 270 can be made of a metal, plastic, or other rigid or semi-rigid materials to provide the stability needed for the body 200 and/or head 400 to maintain its decorative shape. The frames 260 and 270 can be white, but can also be many alternative colors depending on the application. For outdoor use, the frames 260, 270 and other components can preferably be rust-resistant and/or weatherproof.

The frames 260 and 270 need not be limited to the border/perimeter of the design, but can also comprise internal bracing and/or framework as necessary to provide additional rigidity. Portions of the frame assemblies 260 and 270 can provide transition, displaying a three-dimensional depth of the decorative light system 100, and provide borders for the design. The one or more frame members 262 and 272 of each frame assembly 260 and 270 can further comprise a perimeter and an interior. In some embodiments, the interior can include an opening 515 for receiving a portion of the mount assembly 280, as described in more detail below. See, FIG. 5.

In an exemplary embodiment, each perimeter can have a particular shape to provide the overall shape for the body 200. In FIGS. 2*a*-2*b*, the decorative system 100 is a snowman. In this configuration, the perimeter of each frame member 262, 272 can be a circle or oval and can have different diameters. In an exemplary embodiment, the interior can include one or more crossbars 505 with the opening 515, or ring, at the approximate center of the perimeter for supporting the perimeter. Other shapes for the interior and perimeter can be provided, and hence the shape of the body 200 and the decorative system 100 can change accordingly.

The decorative covering 290 can be disposed over, or attached to, the frame assemblies 260, 270. In other words, the decorative covering 290 can be in communication with the first frame assembly 260 and second frame assembly 270. As a result, the first and second frame assemblies 260 and 270 can provide the structure and/or shape of the body 200, and the overall decorative system 100. The decorative covering 290 can include decorative features, including but not limited to, facial features, clothes, or accessories.

The decorative covering(s) 290 can comprise a flexible material such as, for example and not limitation, cotton, polyester, or plastic. The decorative covering(s) 290 can further comprise a design or other features that can be, for example, sewn, printed, silkscreened, or embossed onto material of the decorative covering(s) 290. In some embodiments, two covers 290 can be used, one for the head 400 and one for the body 200. The cover 290 for the head 400 can include, for example, facial features, designs, or lettering. The cover 290 for the body 200 can include, for example, clothing, accessories, or body parts (e.g., arms). In some embodiments, both covers 290 can have the same design (e.g., Happy Birthday). In still other embodiment, a single cover 290 can cover both portions of the system 100.

The mount assembly 280 can provide support, and can be in communication with the first frame assembly 260 for support of the decorative system 100. The mount assembly 280 can be removable, enabling the first and second frame assemblies 260, 270 to collapse or fold. This configuration can, for example, provide convenient storage and shipping. Removal of the mount assembly 280 from the first frame assembly 260 enables the decorative system 100 to collapse creating a thin profile.

In some embodiments, the mount assembly 280 can extend from the first base 220 of the body 200 to the top, or upper section, of the body 200. In some embodiments, a second base 410 can extend from a bottom of the head 400 to the top of the head 400. Like the first base 220, the second base 410 can comprise an upright 422. In some embodiments, the second upright 422 can extend from the bottom of the head 400 to the top of the head 400.

In some embodiments, the biasing member 300 can be carried by the body 200. The biasing member 300 can be, for example and not limitation, a coil or flat spring. In other embodiments, the biasing member 300 can comprise a suitably flexible plastic or other material. A first end 302 of the biasing member 300 can be in communication with the body 200. The biasing member 300 can be in communication with an upper section 205 of the body 200. The biasing member 300 can be, for example and not limitation, bolted, welded, or adhered to the upper section 205 of the body 200.

The head 400 of the decorative system 100 can be in communication with a second end 304 of the biasing member 300 such that the head 400 can be carried by the biasing member 300 via the body 200. In this configuration, the head 200 is adapted to wobble or bobble relative to the body 200 upon contact or movement of the body 200 or head 400 by virtue of the biasing member 300. In an exemplary embodiment, like the body 200, the head 400 can comprise a plurality of frame members 272, which can be interconnected to provide the skeleton, or framework, for the head 400. The head 400 can have similar characteristics as described above for the body 200, and thus can include a plurality of frame assemblies 405, a second base 410, and a decorative covering 290. In some embodiments, the body 200 and the head 400 can be covered in a complimentary covering 290. As shown, the covering 290 can form the head and clothing of a snowman. Of course, the covering 290 can display many other types of themes and decorations including, but not limited to, Christmas, Halloween, and Easter decorations, famous athletes, celebrities, and religious symbols.

In other embodiments, the body 200 can comprise an inner body and an outer body. In this configuration, the inner body can act as the support and the outer body can be mounted thereto using one or more biasing members 300. In this configuration, the outer body and/or the head 400 can move with respect to the inner body and/or base 200. In this configuration, the outer body can move to simulate, for example and not limitation, running, dancing, or play. In some embodiments, this configuration can be used to simulate a "hula" dancer, or similar.

In some embodiments, the light string system 500 can be mounted on one or more of the body 200, the biasing member 300, and/or the head 400. The light string system 500 can comprise a plug for insertion into a power outlet, a plurality of bulb assemblies, and wiring between each bulb assembly. Each bulb assembly can comprise a light source and a socket assembly.

The light string system 500 can be in communication with, carried by, and/or secured to any one of the body 200, the biasing member 300, and the head 400. The light string system 500 provides illumination to the decorative system 100 and provides a decorative light system. In some embodiments, the lights string system 500 can comprise clear, frosted, or colored lights and can have solid or flashing lights. In some embodiments, the lights can, for example, flash in a pattern or can be synchronized to music.

Figure 3:
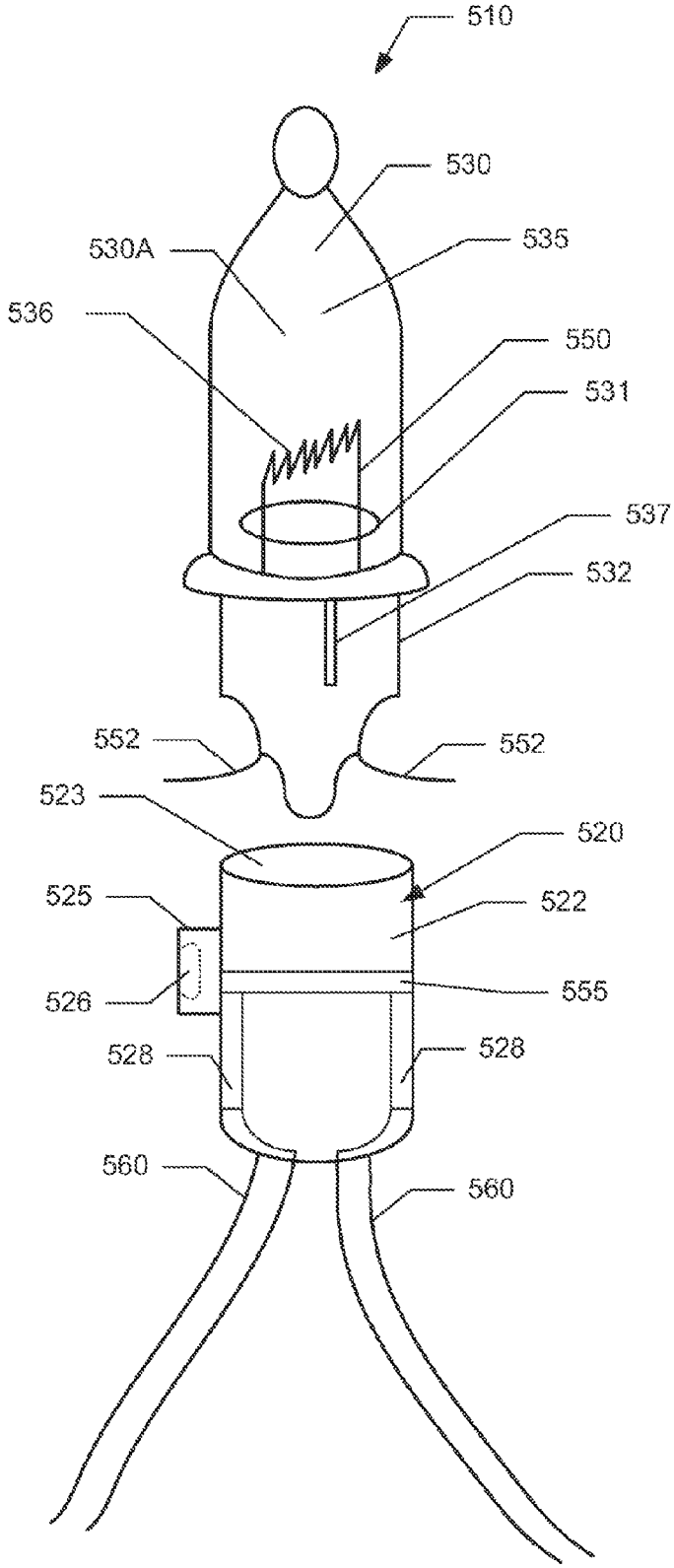
FIG. 3 is a side, partial cross-sectional view of a bulb assembly and socket from a light string system of the decorative system, in accordance with an exemplary embodiment of the present invention.
Figure 4:
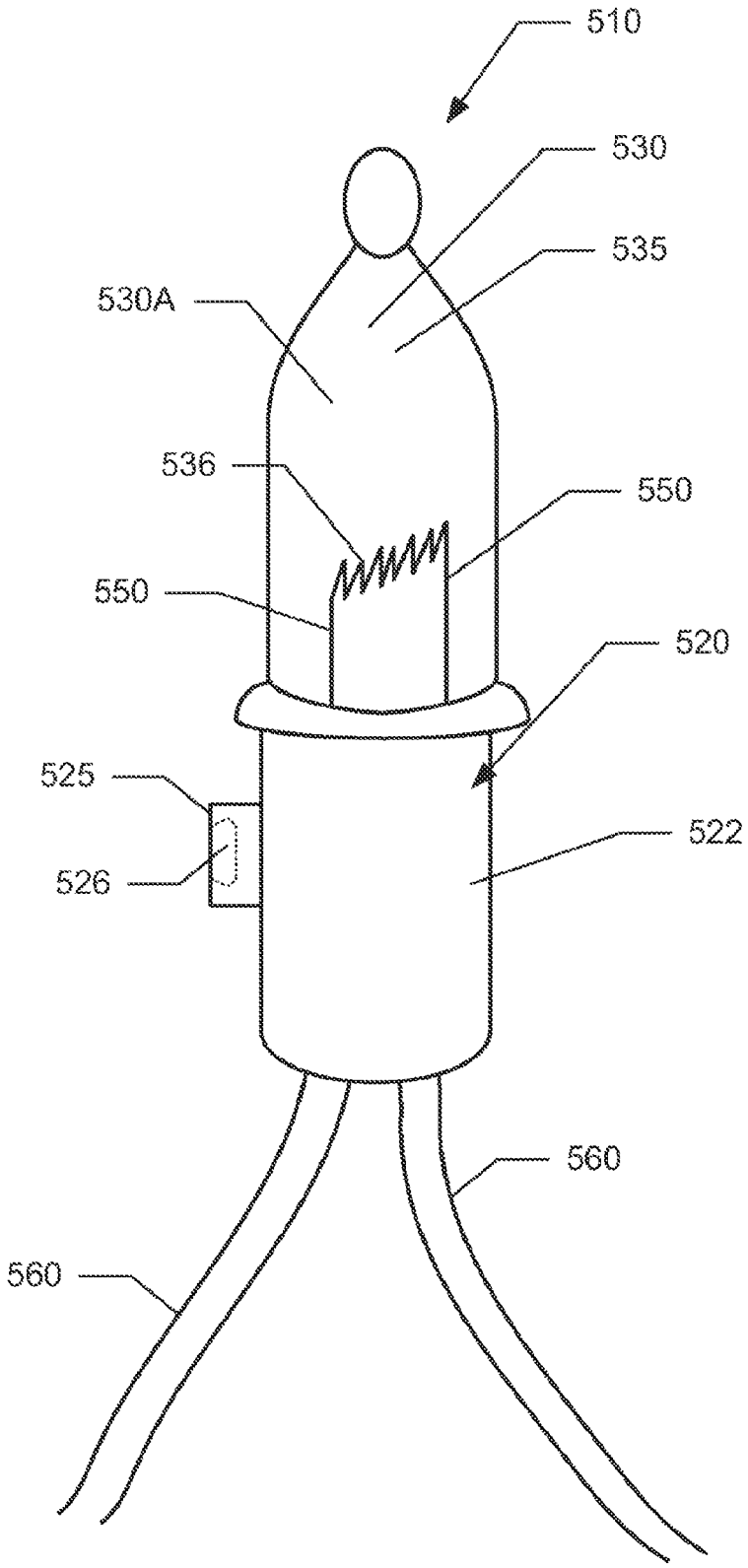
FIG. 4 is a side, partial perspective view of the bulb assembly from the light string system of the decorative system of FIG. 3, wherein a light source is seated in a socket assembly, in accordance with an exemplary embodiment of the present invention.

Referring now to FIGS. 3-4, the light string system 500 can comprise a plurality of bulb assemblies 510, each bulb assembly 510 including a light source 530, a base 532, and a socket assembly 520. The light source 530 can provides light when power is provided to the light string 500. The light source 530 can be many types of light sources, including, but not limited to, conventional incandescent light bulbs, light emitting diodes (LED), halogen lamps, and fluorescent lamps.

In one embodiment, the light source 530 is a light bulb 530A. In a conventional series connected light string system, however, the loss of one bulb (e.g., if a bulb burns out) can cause the entire string to stop functioning. As a result, the bulb assembly 510 can include a shunting mechanism 531 to maintain continuity in the light string system 500. The aforementioned shunting mechanism 531 can keep the light string system 500 illuminated if continuity of lost (e.g., one or more of the light bulbs 530A burns out) by providing an alternate electrical path.

In some embodiments, the light bulb 530A can include a globe 535 and a filament 536. The globe 535 can be in communication with, and terminate at, the base 532. The globe 535 can be made of conventional translucent or transparent material such as, for example and not limitation, plastic, glass, or polycarbonate. Typically, for an incandescent bulb, the globe 535 defines a hollow interior for physical protection of the filament 536 and enables a vacuum to be placed on the filament. The filament 536, when provided with electricity, then illuminates the light bulb 530A.

Conductors 550 can be in electrical communication with the filament 536. The conductors 550 can provide electricity to the light bulb 530A to illuminate the filament 536, and thus the light bulb 530A. The conductors 550 can extend down through the base 532, wherein the conductors 550 can be in communication with a pair of lead wires 552 external the base 532. The lead wires 552 can extend through a bottom of the base 532, and can connect the base 532 to the remainder of the light string system 500.

The bulb assembly 510 can further include the base 532. In some embodiments, the base 532 can be integrally formed with the light source 530, or can be a separate element. The base 532 can communicate between the light bulb 530A and an associated socket 522 of the socket assembly 520, enabling the light bulb 530A to seat, and be electrically connected, by the socket 522. In some embodiments, the base 532 can incorporate one or more ridges 537. The ridges 537 can ensure a snug fit with the socket 522 and can prevent accidental disengagement of the light bulb 530A from the socket assembly 520. Other mechanical or magnetic means can be used with the base 532 and the socket assembly 520 to ensure a tight fit.

The socket assembly 520 can comprise the socket 522, which can be adapted to receive the light bulb 530A/base 532. The socket 522 defines a cooperatively-shaped aperture 523 to receive the base 532 of the bulb assembly 510. The socket 522 can be arranged in many shapes and sizes, but the socket 522 should be of a shape to conveniently receive and retain the light bulb 530A and/or the base 532.

The socket 522 further includes a pair of socket terminals 528. The socket terminals 528 can be located on opposing inner sides of the socket 522. The socket 522 further includes a pair of terminal wires 560 extending to the exterior for electrical connection of the socket 522. Each socket terminal is, electrically, an extension of each respective terminal wire 560. The terminal wire 560 can extend through the bottom of the socket 522 and can be connected to the remainder of the light string system 500 and ultimately to an electrical source.

As mentioned above, light strings, such as the decorative system 100, are typically arranged with bulb assemblies 510 on the strings electrically connected in series, rather than in a parallel arrangement. This is economical as it minimizes the length of wire necessary to connect the lights. Unfortunately, when even a single light bulb is removed from a socket, the entire series of lights is rendered inoperable. Because each light bulb within its respective socket completes the electrical circuit, when a light bulb is removed or the filament of the bulb burns out, a discontinuity is created in the circuit; that is, an open circuit is created. Thus, electricity is unable to continue to flow through the circuit.

To overcome this dilemma, the socket assembly 520 can include a shunting device 555 to enable the light string system 500 to function even when a light source 530 is absent from the socket 522. For instance, the light bulbs 530A in the light string system 500 will remain illuminated even though there may exist: an open (burned out) filament 536, a bad (e.g., dirty) connection, a faulty or damaged light bulb 530A, faulty socket 522, a light bulb 530A is not properly seated in its socket 522, or a bulb 530A that is entirely removed (e.g., it falls out of its socket 522). The bypass activating system described in Massabki et al., U.S. Ser. No. 11/573,505, filed Jun. 23, 2006, the entire disclosure of which is incorporated herein by reference, for example, can be used as the shunting device 555.

The socket assembly 520 can further comprise a mounting member 525, which is external to the socket 522. Upon light installation of the decorative system 100, the extending member 525 can be clipped, taped, or otherwise secured to the decorative system 100. The extending member 525 can include a loop or grip 526. In some embodiments, the grip 526 can be sufficiently sized to secure at least the two terminal wires 560. In other embodiments, the mounting member 525 can comprise a clip sized and shaped to clip onto one or more of the frame members (e.g. 272). In other embodiments, the extending member can comprise a slot, or other means, for receiving Velcro®, zip ties, wire ties, or other attachment means.

Figure 5:
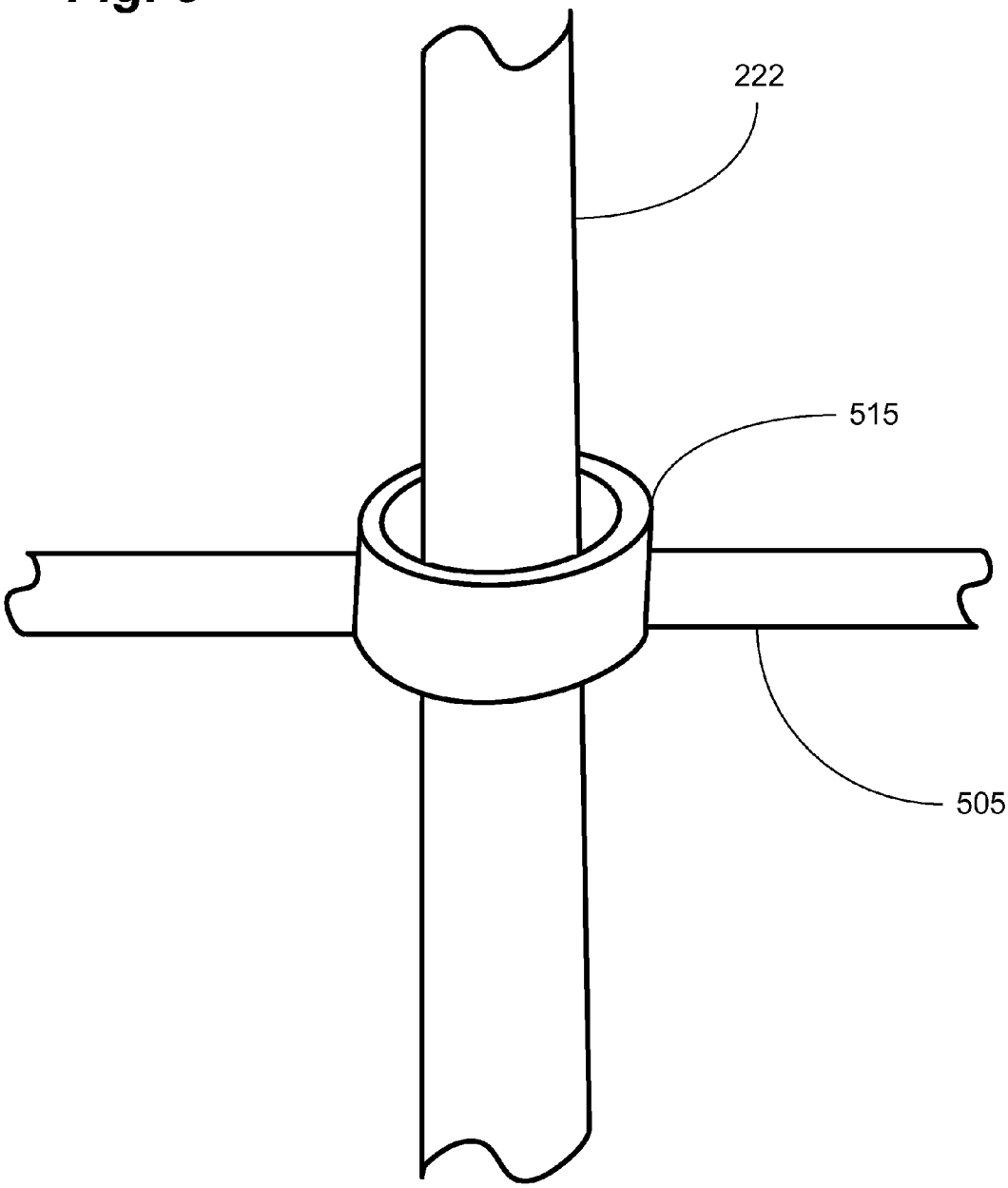
FIG. 5 is a perspective, detailed view of a frame member and upright for the decorative system, in accordance with an exemplary embodiment of the present invention.

As shown in FIG. 5, in some embodiments, the frame assemblies 260, 270 can further comprise one or more crossbars 505. The crossbars 505 can provide additional rigidity and structure to the frame assemblies 260, 270. In some embodiments, the crossbars 505 can further comprise a hub 515 for slideably engaging the first upright 222. In this configuration, the crossbars 505 can provide shape and structure to the decorative system 100, but can enable the decorative system 100 to collapse into a flat state. In some embodiments, the frame assemblies 260, 270 can be hung from one another with straps or cords to enable them to form the shape of the decorative system 100 in the erected position, but fold flat in the collapsed position. The frame assemblies 260, 270 can be connected, for example and not limitation, using flexible cord, line, or the wires from the light string system 500.

In some embodiments, the decorative system 100 can be a wire frame structure that can be used to create a three-dimensional shape decorative system, of which a portion bobbles or wobbles.

In a preferred embodiment, the decorative system 100 can be collapsible to enable convenient storage, packaging, and/or shipping.

While several possible embodiments are disclosed above, embodiments of the present invention are not so limited. For instance, while several possible configurations have been disclosed (e.g., a lighted, bobble head snowman), other suitable materials and configurations can be selected without departing from the spirit of embodiments of the invention. The present invention can be modified to depict, for example and not limitation, other Christmas decorations, Halloween decorations, such as black cat(s), ghost(s), witch(es), bat(s), pumpkin(s), and jack-o-lantern(s). In addition, the holiday of Thanksgiving can include a decorative system 100, for instance, turkey, cornucopia, pilgrims, Indians, ships, and the like. Still other events, such as Independence Day, birthdays, and Easter can provide decorative light systems. Other examples can include flags (e.g., countries, sports teams, states, and the like) and spelled-out words (e.g., "Happy Birthday," and "Congratulations"). The decorative system 100 is capable of both indoor and outdoor use. In addition, the location and configuration used for various features of embodiments of the present invention can be varied according to a particular decorations size, weight restrictions, or simply user preference. Such changes are intended to be embraced within the scope of the invention.

The specific configurations, choice of materials, and the size and shape of various elements can be varied according to particular design specifications or constraints requiring a device, system, or method constructed according to the principles of the invention. For example, while certain exemplary ranges have been provided for thicknesses and locations, other configurations can be used for different sized containers or cargos. Such changes are intended to be embraced within the scope of the invention. The presently disclosed embodiments, therefore, are considered in all respects to be illustrative and not restrictive. The scope of the invention is indicated by the appended claims, rather than the foregoing description, and all changes that come within the meaning and range of equivalents thereof are intended to be embraced therein.

What is claimed is:

1. A system for providing a decorative light system comprising:

a body comprising a first frame and having an upper portion; a biasing member, with a first end and a second end, the first end in communication with the upper portion of the body; a head comprising a second frame and having an extreme bottom at the lowermost portion of the head, the head disposed generally above the body and the extreme bottom of the second frame of the head in communication with the second end of the biasing member such that a gap is located between the upper portion of the body and the extreme bottom of the second frame of the head and such that the biasing member is disposed in the gap; and a light string system in communication with one or more of the body, the biasing member, and the head for providing illumination on the decorative light system; wherein the biasing member springedly attaches the head to the body to enable the head to move with respect to the body; and wherein the first frame and the second frame are wire assemblies which are collapsible and can be collapsed separately from an erect state into a substantially flat state.

2. The system of claim 1, further comprising a base attached to the body for supporting the body.

3. The system of claim 2, wherein the body rotates with respect to the base.

4. The system of claim 1, wherein the biasing member is a coil spring.

5. The system of claim 1, wherein the biasing member is a flat spring.

6. The system of claim 1, wherein the body and head further comprise one or more frame members; and wherein the one or more frame members form a framework for the decorative light system.

7. The system of claim 6, further comprising one or more decorative covers size and shaped to cover the one or more frame members;

wherein the decorative covers provide a decorative appearance for the decorative light system.

8. A system for providing a decorative light system comprising:

a body comprising an upper portion and one or more first frame assemblies for providing a framework for the body;

a biasing member, with a first end and a second end, the first end in communication with the upper portion of the body;

a head comprising an extreme bottom at the lowermost portion of the head and one or more second frame assemblies, the head disposed generally above the body and the extreme bottom of the head in communication with the second end of the biasing member such that a gap is located between the upper portion of the body and the extreme bottom of the head and such that the biasing member is disposed in the gap;

a light string system in communication with the body and the head for providing illumination on the decorative light system, the light string system spanning the gap between the upper portion of the body and the extreme bottom of the head to provide illumination to both the body and the head;

a first base, in communication with the body, for supporting the decorative light system; and one or more decorative coverings sized and shaped to conform to one of the body and the head to provide a decorative appearance to the decorative light system;

wherein the biasing member springedly attaches the head to the body to enable the head to move with respect to the body; and wherein the first and second frame assemblies are separately collapsible to enable the body and head to be separately collapsed into a flat state.

9. The decorative light system of claim 8, wherein the light string system further comprises a shunting mechanism.

10. The decorative light system of claim 8, wherein the light string system further comprises an attachment means to enable the light string system to be attached to one or more of the first base, the body, and the head.

11. The decorative light system of claim 8, further comprising:

a first decorative covering for covering the body; and a second decorative covering for covering the head.

12. The decorative light system of claim 8, further comprising a first upright with a first end and a second end;

wherein the first end of the first upright is in communication with the first base; and wherein the second end of the first upright is in communication with an upper portion of the body for supporting the body.

13. The decorative light system of claim 8, further comprising:

a second base disposed generally underneath the head; and a second upright, with a first end and a second end;

wherein the first end of the second upright is in communication with the second base; and wherein the second end of the second upright is in communication with an upper portion of the head for supporting the head.

14. The decorative light system of claim 13, wherein each of the second frame assemblies further comprises:

one or more crossbars, each crossbar comprising a hub;

wherein each hub is sized and shaped to be disposed around the second upright.

15. The decorative light system of claim 8, wherein each of the first frame assemblies further comprises:

one or more crossbars, each crossbar comprising a hub;

wherein each hub is sized and shaped to be disposed around the first upright.

16. A method of manufacturing a decorative light system comprising:

providing a first wire frame assembly having one or more wire members such that, when erected, the first wire frame assembly provides a collapsible lower body element for the decorative light system;

providing a second wire frame assembly having one or more wire members such that, when erected, the second wire frame assembly provides a collapsible upper body element, the collapsible upper body element being a substantially round head having an extreme bottom at the lowermost portion of the head;

providing a biasing member for springedly coupling the extreme bottom of the upper body element to the lower body element;

providing a light string system, attachable to one or more of the upper body element, the lower body element, and the biasing member for illuminating the decorative light system; and providing one or more decorative covers sized and shaped to cover the upper body element, the lower body element, or both;

wherein the wire frame assemblies of the collapsible lower body element and the collapsible upper body element can be separately collapsed from an erect state into a substantially flat state.

17. The method of manufacturing of claim 16, wherein the first and second frame assemblies comprise welded wire.

18. The method of manufacturing of claim 16, wherein the first and second frame assemblies comprise a molded thermoplastic.

19. The method of manufacturing of claim 16, further comprising:

providing a first base, comprising a base frame and an upright, for supporting the lower body element.

* * * * *